US007982564B2

(12) United States Patent
Farrar et al.

(10) Patent No.: US 7,982,564 B2
(45) Date of Patent: Jul. 19, 2011

(54) STARTER SOLENOID WITH VIBRATION RESISTANT FEATURES

(75) Inventors: Peter K Farrar, Indianapolis, IN (US); David A. Fulton, Anderson, IN (US); Darrell Stephens, Anderson, IN (US)

(73) Assignee: Remy Technologies, LLC, Pendleton, IN (US)

( * ) Notice: Subject to any disclaimer, the term of this patent is extended or adjusted under 35 U.S.C. 154(b) by 379 days.

(21) Appl. No.: 12/164,106

(22) Filed: Jun. 30, 2008

(65) Prior Publication Data

US 2009/0322456 A1 Dec. 31, 2009

(51) Int. Cl.
*H01H 67/02* (2006.01)

(52) U.S. Cl. ..... 335/126; 335/131

(58) Field of Classification Search ..... 335/126, 335/131, 201

See application file for complete search history.

(56) References Cited

U.S. PATENT DOCUMENTS 3,189,705 A * 6/1965 Geusendam ..... 335/194
3,225,159 A * 12/1965 Myrent et al. ..... 335/126
4,367,448 A * 1/1983 Nishizako ..... 335/201
4,638,275 A * 1/1987 Belbel et al. ..... 335/151
4,855,698 A * 8/1989 Cohen et al. ..... 335/14
4,947,145 A * 8/1990 Ohishi et al. ..... 335/14
5,233,321 A * 8/1993 Blanchard et al. ..... 335/132
5,546,061 A * 8/1996 Okabayashi et al. ..... 335/78
5,635,886 A * 6/1997 Pichard ..... 335/132
6,310,528 B1 * 10/2001 Kuboyama et al. ..... 335/132
6,456,177 B1 * 9/2002 Linnarud et al. ..... 335/106
7,157,996 B2 * 1/2007 Enomoto et al. ..... 335/132

* cited by examiner

*Primary Examiner* — Lincoln Donovan
*Assistant Examiner* — Alexander Talpalatskiy
(74) *Attorney, Agent, or Firm* — Maginot, Moore & Beck

(57) ABSTRACT

A starter solenoid comprises a solenoid cap defining a contact channel. A first terminal and a second terminal are provided on the solenoid cap. A contact is moveable within the channel between a first position where the contact touches the first and second terminals and a second position where the contact is removed from the first and second terminals. A shield is positioned in the channel to space the contact apart from the channel walls. The contact comprises a first terminal face connected to a second terminal face. The first and second terminal faces are configured to respectively contact the first and second terminals when the contact is in the first position. Opposing lips extend from opposite sides of the first terminal face with a curved shoulder provided between the first terminal face and each of the opposing lips.

17 Claims, 9 Drawing Sheets

STARTER SOLENOID WITH VIBRATION RESISTANT FEATURES

FIELD

This invention relates to the field of motors, and more particularly starter motors for vehicles.

BACKGROUND

A typical automobile engine starter includes a solenoid that is activated upon closing an ignition switch. As shown in FIG. 7, the typical solenoid includes two terminals 110 and 112 positioned within a solenoid cap 116 on the end of the solenoid. The cap 116 is generally comprised of a non-conductive material, such as a plastic, that insulates the terminals from each other. A contact 114 for establishing an electrical connection between the terminals 110 and 112 is also provided within the cap 116. The contact 114 is provided as a metal plate secured to the end of a rod 118. The contact plate 114 and rod are biased by a return spring 120 away from the terminals 110 and 112. The opposite end of the rod 18 from the contact plate 114 is coupled to a solenoid plunger. When the operator of the automobile cranks the engine by turning a key, an ignition switch is closed and electric current is provided to the solenoid windings. Upon excitation of the solenoid, the plunger shifts in position and forces the rod 118 and the contact 114 toward the terminals 110 and 112 until the contact plate 114 comes into contact with the terminals 110 and 112. When the contact 114 physically touches the terminals 110 and 112, an electric circuit is completed which provides cranking current to the starter motor.

FIG. 8 shows an exemplary contact 114 for a starter motor. The exemplary contact 114 is provided as a flat and rectangular plate with two side portions 120 and 122 separated by an enlarged center portion 124. The contact plate 114 includes a first terminal face 121 and a second terminal face 123. A hole 126 is provided in the center portion 124 which allows the plate 114 to be connected to a contact rod 118. The edges 128 of the contact plate 114 are well defined, resulting in sharp edges along the contact 116. The edges 128 of the contact plate meet at corners 129 that are also well defined and sharp.

FIG. 9 shows the contact plate of FIG. 8 positioned in a solenoid cap 116. The solenoid cap of FIG. 9 is shown at a 90° angle compared to the cap shown in FIG. 7 such that only one of the terminals 112 is seen in FIG. 9. The contact plate 114 slides back and forth within a channel 130 formed in the solenoid cap 116. The contact plate 114 is arranged in the channel 130 of the solenoid cap 116 such that the sides of the contact plate 114 are closely positioned along the channel walls 131.

In a high vibration environment, as may be seen with certain vehicles at starting, the edges 128 and corners 129 of the contact plate 114 will bump into the channel walls 131. Back and forth movement of the contact plate 114 along the channel in such a high vibration environment causes the sharp edges 128 and corners 129 of the contact plate 114 to wear against the channel walls 131, digging into the channel walls 131 and creating a groove in the cap 116. This wear on the channel walls also results in the creation of a non-conductive dust that may settle on the terminal 112. The non-conductive dust may eventually result in a non-conductive covering on the terminal 112 that prevents the contact 114 from establishing an electrical connection between the two terminals. When this happens, a click-no-crank situation results, where the solenoid is activated, but power is not delivered to the starter motor because the contact never establishes an electrical connection between the terminals. Accordingly, it would be advantageous to provide a starter solenoid capable of operating in a high vibration environment without the contact plate wearing on the sides of the solenoid cap.

SUMMARY

A starter solenoid comprises a solenoid cap defining a contact channel. A first terminal and a second terminal are provided on the solenoid cap. The starter solenoid further comprises a contact moveable within the channel between a first position where the contact touches the first and second terminals and a second position where the contact is removed from the first and second terminals. The contact comprises a first portion including a first terminal face configured to contact the first terminal when the contact is in the first position. Opposing lips extend from opposite sides of the first terminal face with a curved shoulder provided between the first terminal face and each of the opposing lips. The contact further comprises a second portion connected to the first portion. The second portion includes a second terminal face configured to contact the second terminal when the contact is in the first position.

In at least one embodiment, the starter solenoid further comprises a shield positioned in the channel of the solenoid cap. The shield is configured to protect the solenoid cap by keeping the contact spaced apart from the solenoid cap when the contact rod moves between the first position and the second position. The shield comprises opposing walls positioned adjacent to the opposing lips. The opposing lips of the contact move along the opposing walls when the contact moves between the first position and the second position within the channel. The shield also comprises an end wall connecting the two opposing walls, the end wall including a hole configured to receive the first terminal.

The above described features and advantages, as well as others, will become more readily apparent to those of ordinary skill in the art by reference to the following detailed description and accompanying drawings. While it would be desirable to provide a starter solenoid that includes one or more of the foregoing or other advantageous features as may be apparent to those reviewing this disclosure, the teachings disclosed herein extend to those embodiments which fall within the scope of the appended claims, regardless of whether they include the above-mentioned features accomplish or provide one or more of the above-mentioned advantages.

DESCRIPTION

Figure 1:
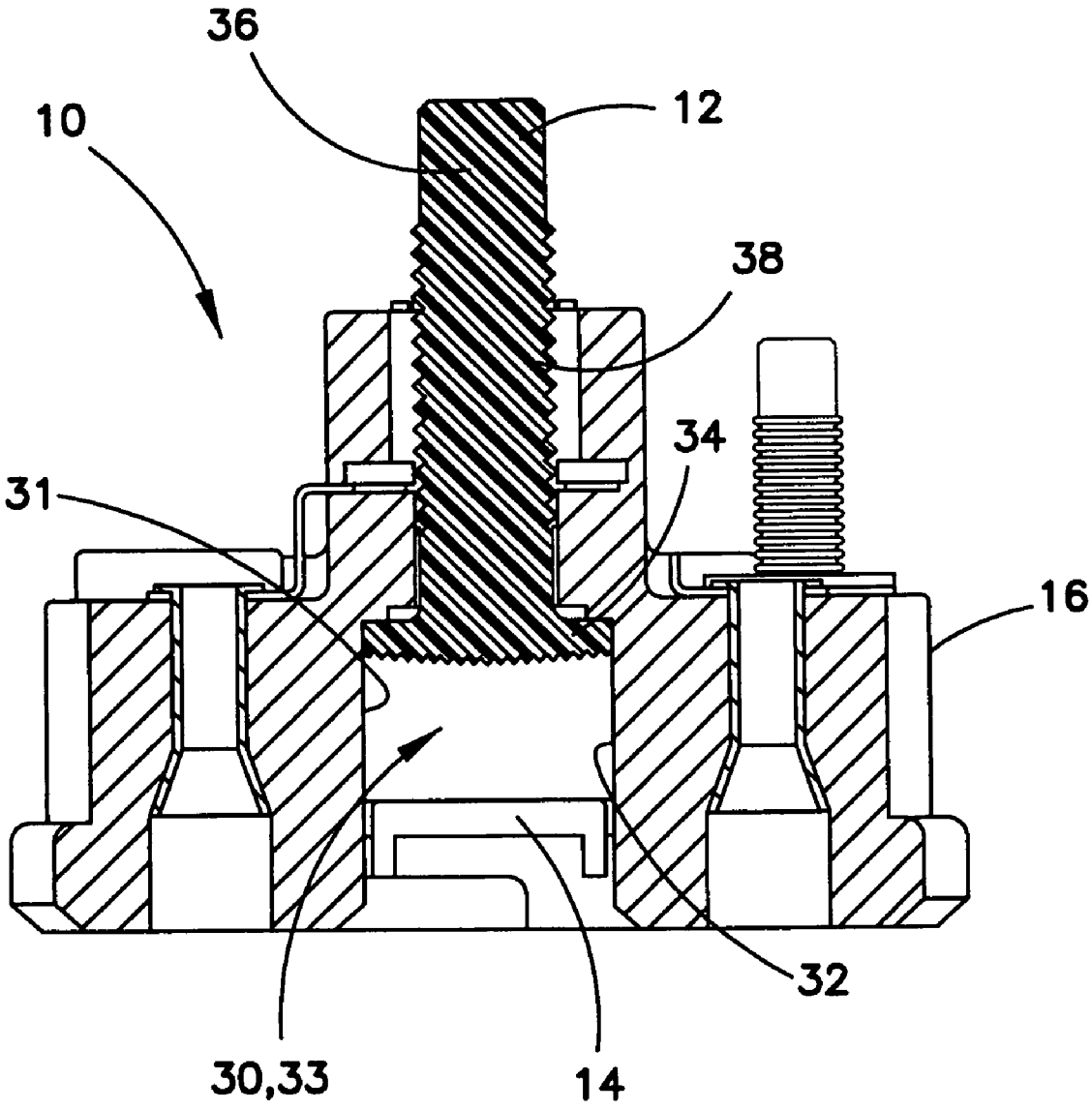
FIG. 1 shows a cutaway view of a cap of a starter solenoid with vibration resistant features.
Figure 2A:
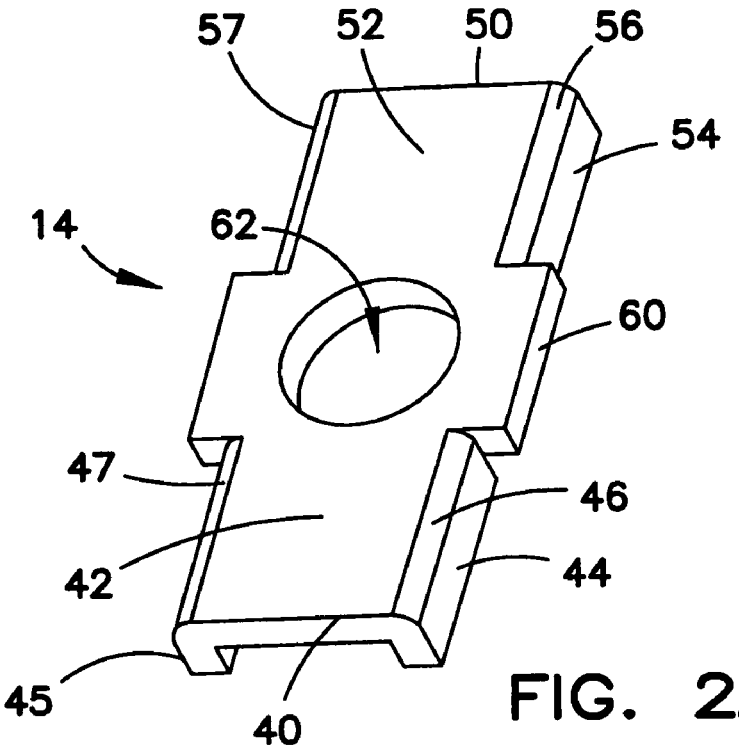
FIG. 2A shows a perspective view of a contact for the starter solenoid of FIG. 1.
Figure 2B:
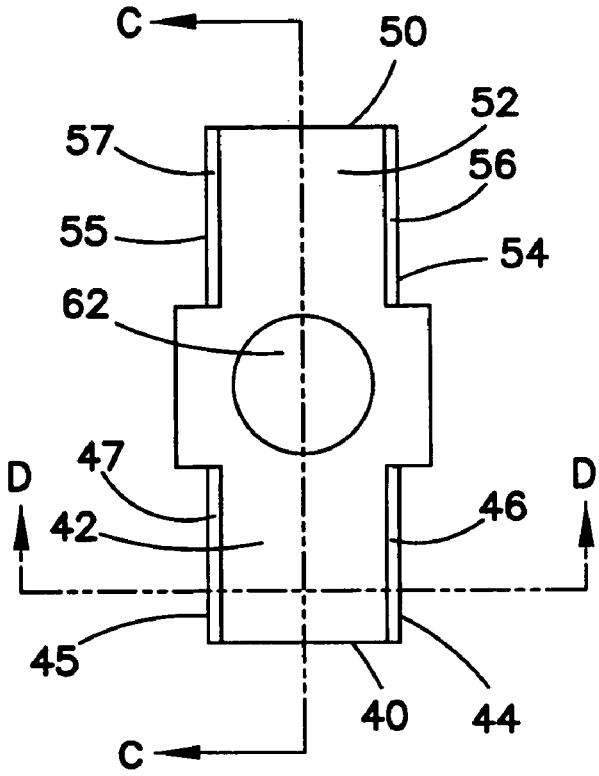
FIG. 2B shows a top view of the contact of FIG. 2A.
Figure 2C:
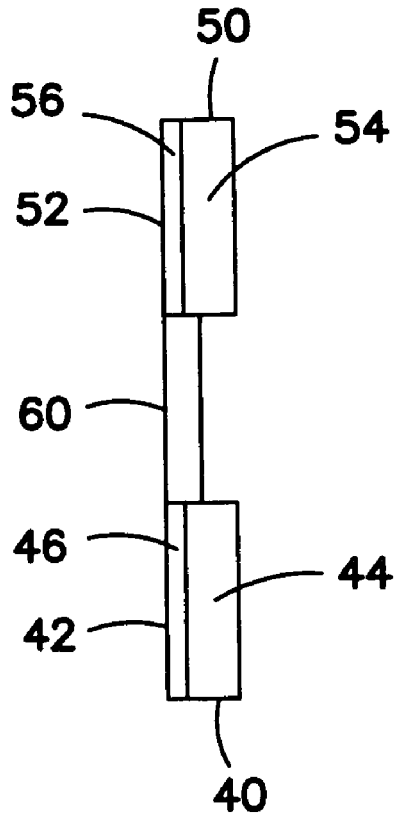
FIG. 2C shows a cross-sectional view of the contact along line C-C of FIG. 2B.
Figure 2D:
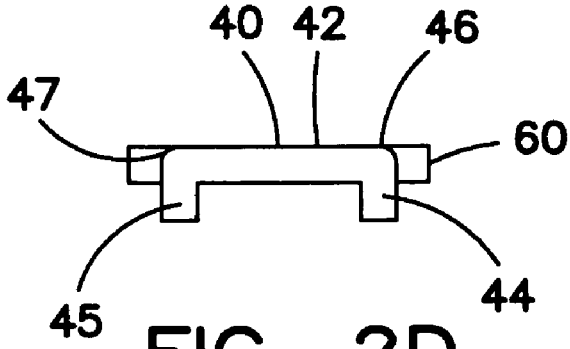
FIG. 2D shows a cross-sectional view of the contact along line D-D of FIG. 2B.
Figure 3:
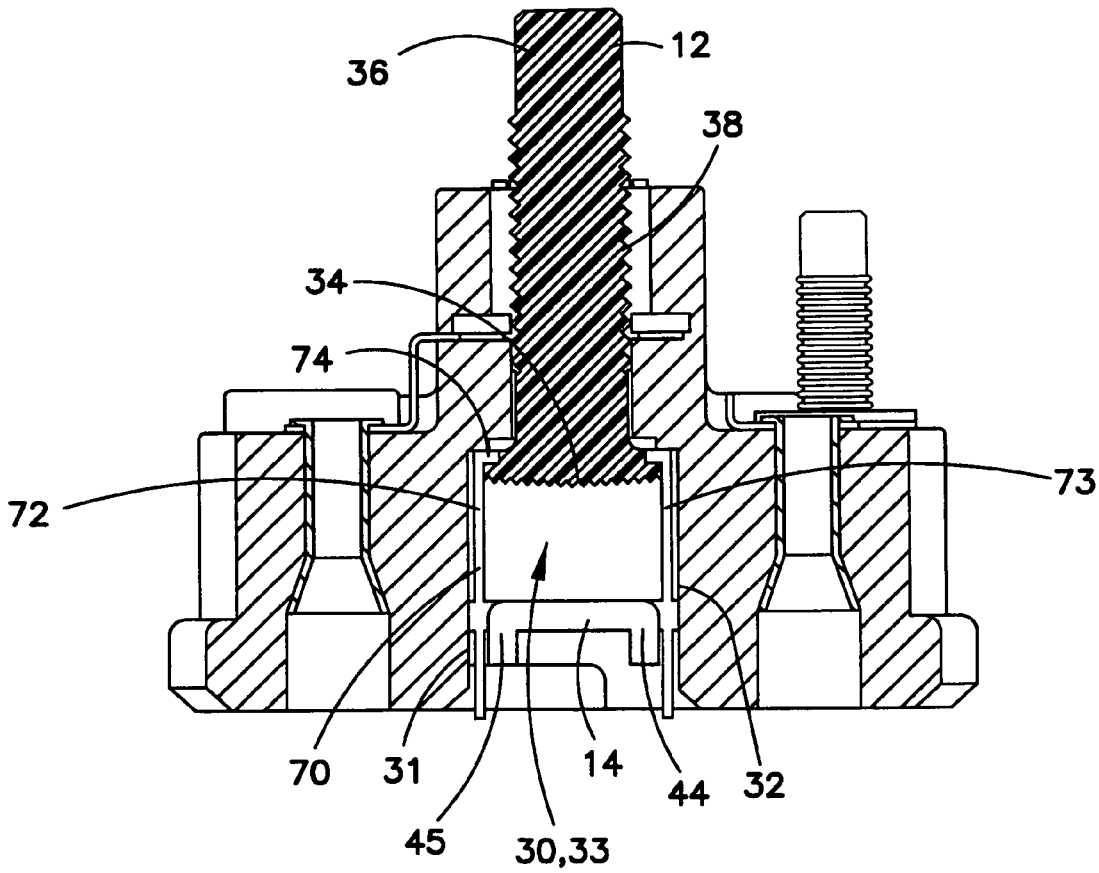
FIG. 3 shows a cutaway view of an embodiment of the starter solenoid with vibration resistant features, the starter solenoid including a shield placed in the cap.
Figure 4:
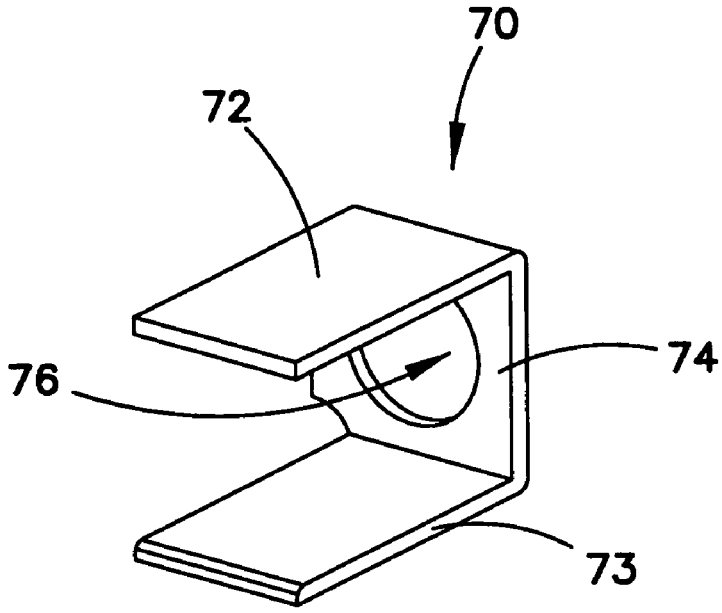
FIG. 4 shows a perspective view of the shield of the starter solenoid of FIG. 3.
Figure 6:
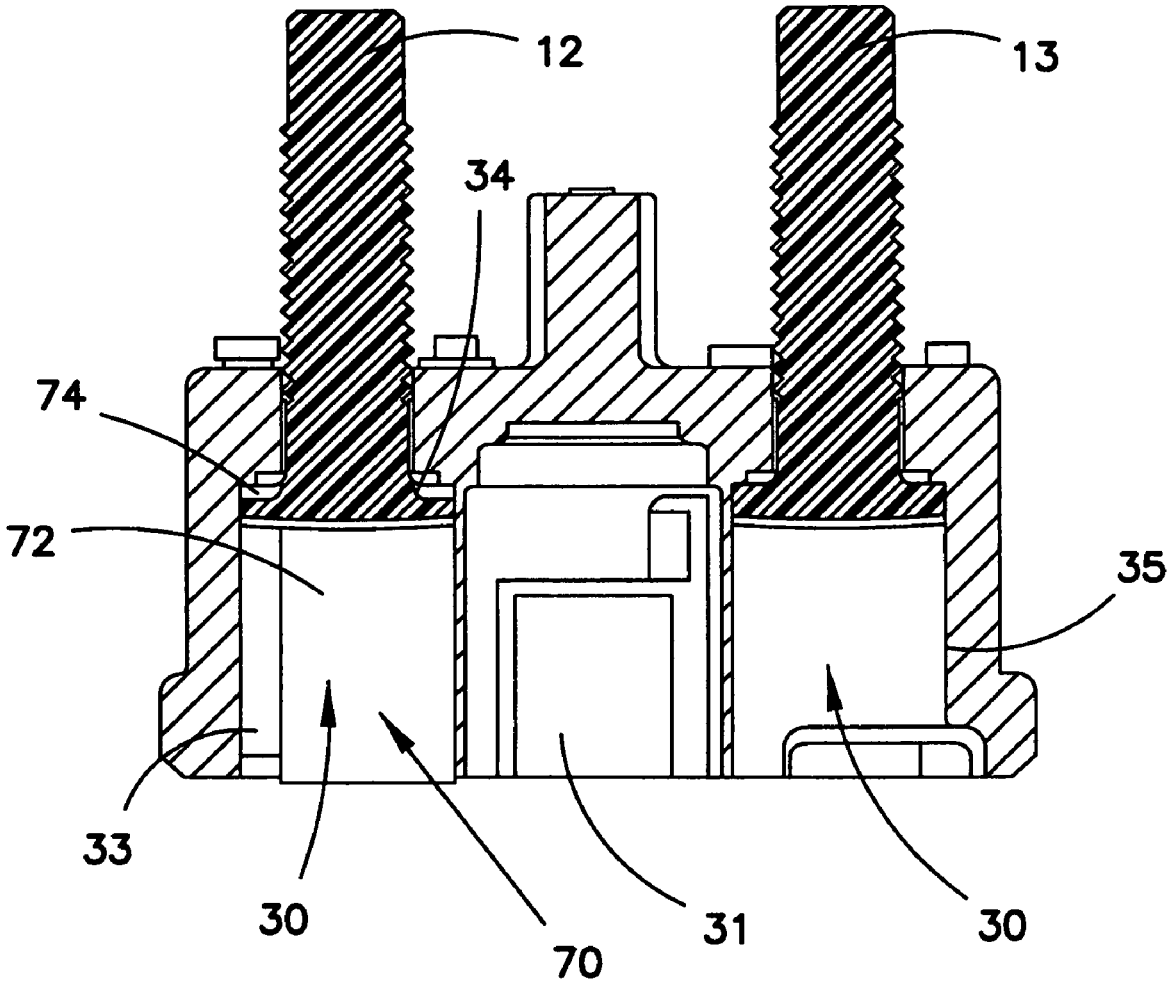
FIG. 6 shows another cutaway view of the starter solenoid rotated 90° relative to the view of FIG. 3.
Figure 7:
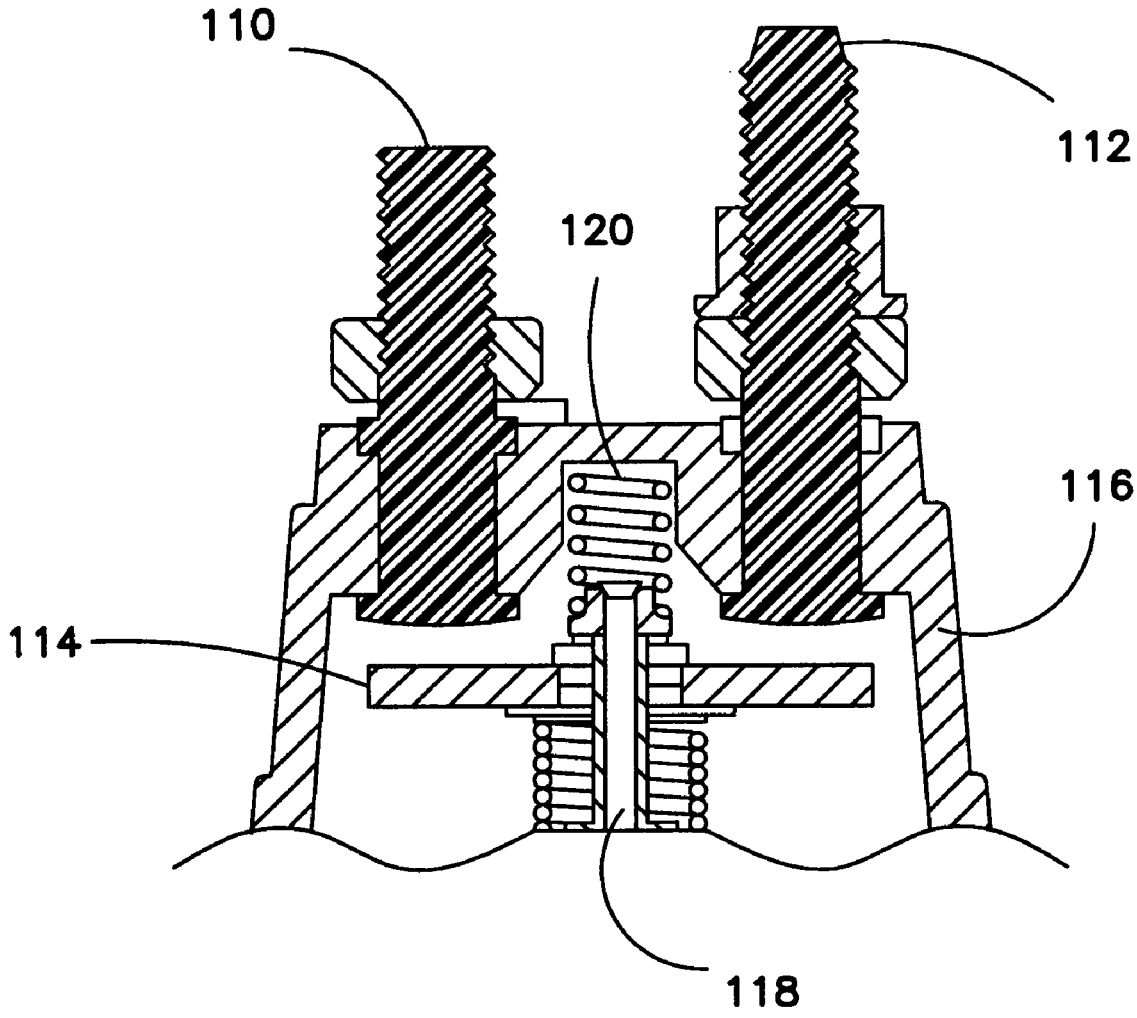
FIG. 7 PRIOR ART
FIG. 7 shows a cross-sectional view of the cap portion of an exemplary prior art starter solenoid.
Figure 8:
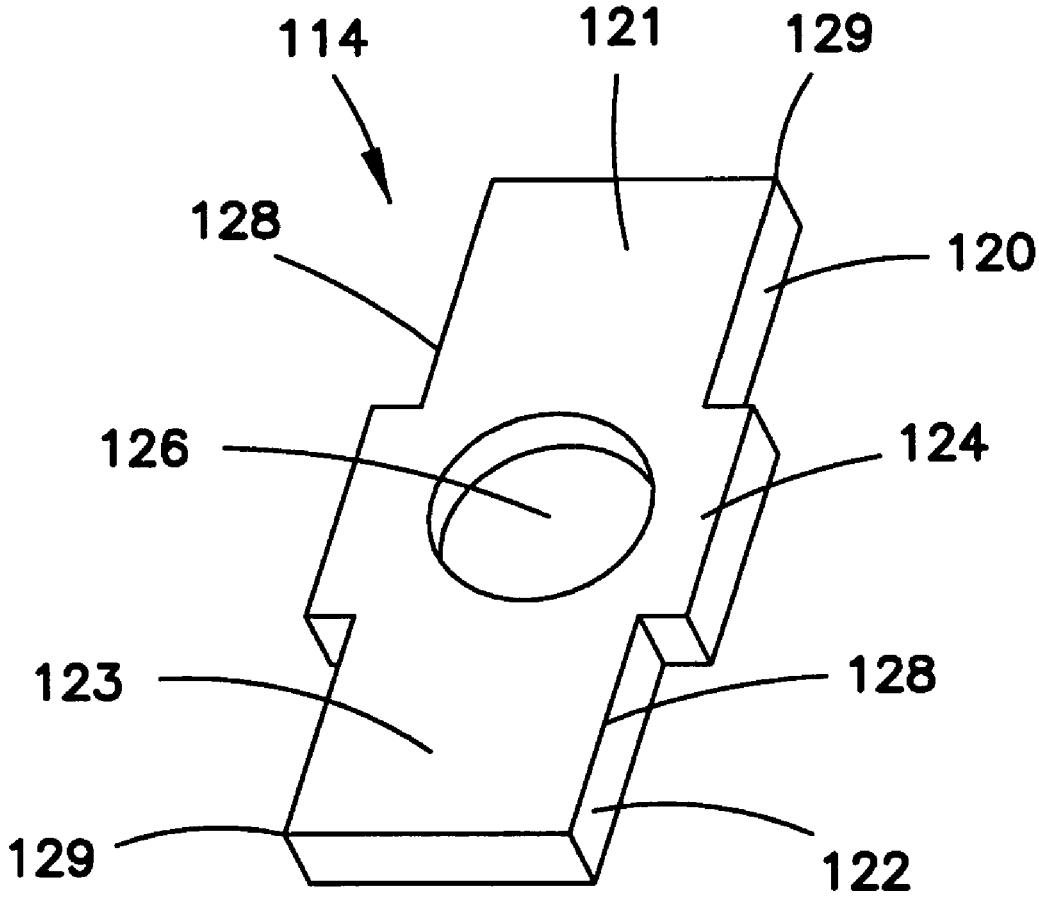
FIG. 8 PRIOR ART
FIG. 8 shows a perspective view of an exemplary prior art contact.
Figure 9:
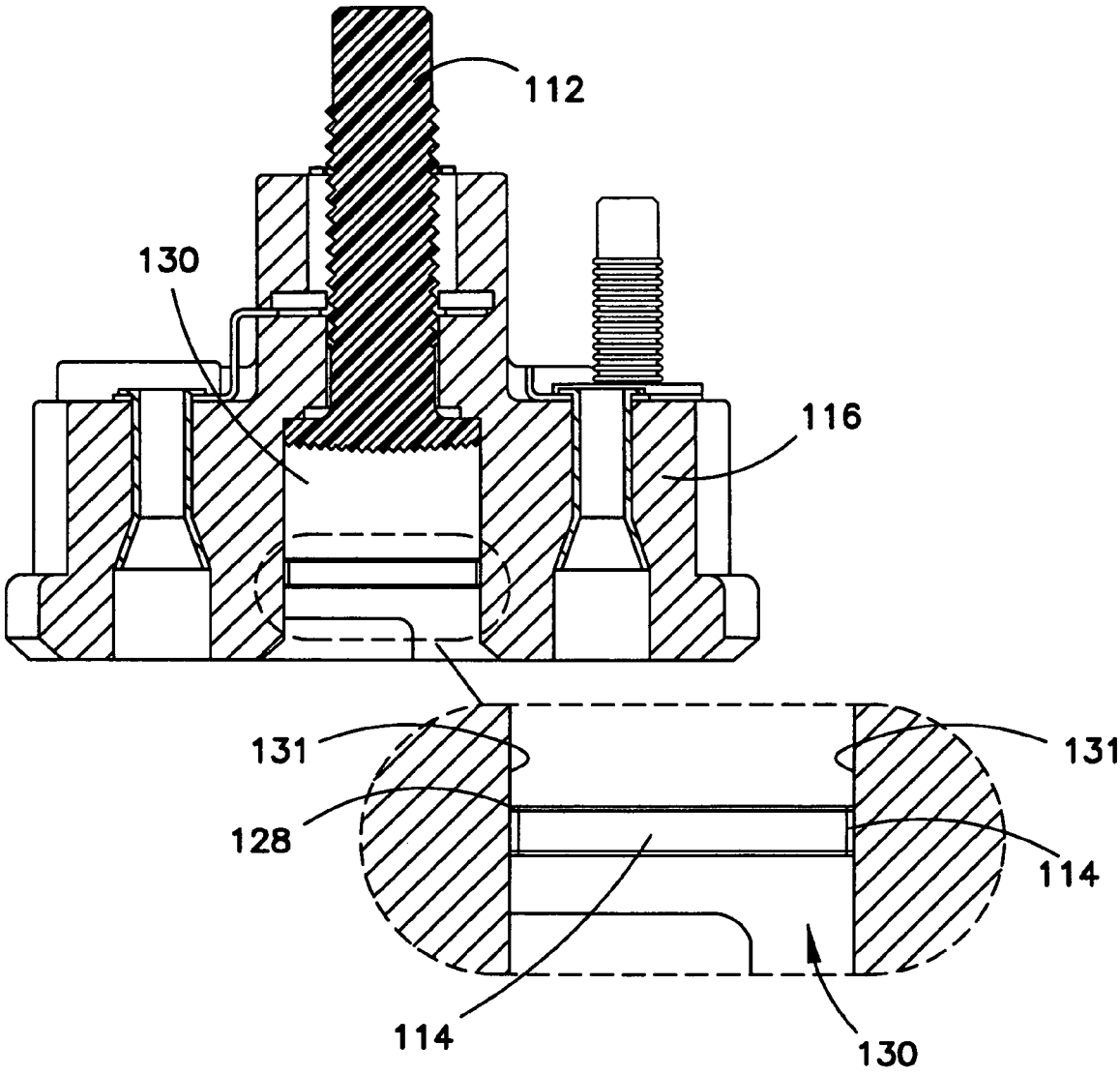
FIG. 9 PRIOR ART
FIG. 9 shows the contact of FIG. 8 situated in another exemplary prior art starter solenoid.

With reference to FIG. 1, a starter solenoid 10 includes a cap 16 with a first terminal 12 and a second terminal 13 (not shown in FIG. 1; see, e.g., FIG. 6) provided on the cap 16. A contact 14 is positioned within the cap 16. The contact 14 slides back and forth within the cap 16 to make and break an electrical connection between the terminals 12, 13.

The first and second terminals 12, 13 are comprised of a strong material which is also electrically conductive, such as steel, or other metal materials commonly used for terminals. Each terminal 12, 13 includes a head portion 34 and a shaft portion 36. The shaft portion 36 includes a threaded center 38 used to secure the terminal to the cap 16. The head portion 34 is positioned inside of the cap 16 and the opposite end of the shaft 36 extends out of the cap 16.

The cap 16 may be configured to fit on to the housing of any of numerous starter solenoids, such as the starter solenoid disclosed in U.S. Pat. No. 6,552,638, the content of which is incorporated herein by reference in its entirety. The cap 16 is generally comprised of a non-conductive plastic material which insulates the terminals 12, 13 from one another.

A contact channel 30 is formed within the cap 16. The channel 30 includes a first terminal side 33 and a second terminal side 35. The head 34 of the first terminal 12 is positioned at the end of the first terminal side and the head of the second terminal 13 is provided at the end of the second terminal side 35 (see FIG. 6).

As shown in FIG. 1, the channel 30 is defined by two opposing sidewalls 31, 32. The head 34 of the terminal 112 extends between the sidewalls 31, 32. The contact 14 is situated between the sidewalls 31, 32 and is slideable within the channel 30 between a first position and a second position. In the first position, the contact 14 touches the terminals 12, 13. In the second position, the contact 14 is removed from the terminals 12, 13.

With reference now to FIGS. 2A-2D, the contact 14 is generally rectangular in shape and includes a first portion 40 and a second portion 50 with an enlarged middle portion 60 provided between the first portion 40 and the second portion 50. A hole 62 is provided in the middle portion 60 which is dimensioned to receive the contact rod of the starter solenoid, allowing the contact 14 to be attached to the contact rod.

The first portion 40 of the contact 14 includes a first terminal face 42 which is configured to contact the first terminal 12 when the contact 14 is in the first position. Opposing lips 44, 45 extend from opposite sides of the first terminal face 42. A curved shoulder 46, 47 is provided between the first terminal face 42 and each of the opposing lips 44, 45. Each shoulder 46, 47 is defined by a radius of curvature which is typically greater than 0.5 mm. In at least one embodiment, the radius of curvature of the shoulder is about 1.0 mm.

The opposing lips 44, 45 extend away from the first terminal face 42 in a perpendicular fashion. The opposing lips 44, 45 may be formed by different methods, such as bending the edges of the contact 14 away from the face 42 or by molding the lips 44, 45 when the contact is formed. The rounded shoulders 46, 47 provided at the edges of the first portion 40 of the contact 14, provide soft curving edges rather than sharp cutting edges. These soft edges significantly reduce the extent to which the contact cuts into the sidewalls 31, 32 in high vibration environments.

With continued reference to FIGS. 2A-2D, the contact 14 further comprises a second portion 50 connected to the first portion 40. The second portion 50 includes a second terminal face 52 configured to contact the second terminal when the contact is in the first position. Similar to the first contact portion 40, the second contact portion 50 includes opposing lips 54, 55 which extend from opposite sides of the second terminal face 52. A curved shoulder 56, 57 is provided between the second terminal face 52 and each of the opposing lips 54, 55.

With reference to FIGS. 3-6, an alternative embodiment is shown where a contact shield 70 is positioned within the contact channel 30 of the solenoid cap 16. The contact shield 70 includes two opposing walls 72, 73 connected by an end wall 74. Shield walls 72 and 73 are rectangular in shape and are spaced apart to allow the first portion 40 of the contact to fit between the two shield walls 72 and 73. Shield wall 72 is provided along channel wall 31 and shield wall 73 is provided along channel wall 32. The end wall 74 of the shield 70 includes a hole 76 configured to receive the first terminal 12. With the shaft 36 of the terminal 12 inserted through the hole 76, the head 34 of the first terminal 12 fits between the opposing shield walls 72, 73. The shield 70 is comprised of a material that is harder than the contact 14. In one embodiment, the shield is comprised of a spring steel material with a tin coating that provides corrosion resistance. Even though the shield is comprised of a metallic material, it does not short out the terminals 12, 13 since it is connected to only one of the terminals.

The shield 70 is configured to protect the solenoid cap 16 by keeping the contact 14 spaced apart from the solenoid cap when the contact moves between the first position and the second position. When the contact 14 is placed in the contact channel 30 with the shield 70 in place, the opposing walls 72, 73 of the shield 70 are positioned adjacent to the opposing lips 44, 45 of the contact 14. The opposing lips 44, 45 of the contact 14 move along the opposing walls 72, 73 of the shield when the contact 14 moves between the first position and the second position within the channel 30. If any wear occurs between the metallic contact and the metallic shield, only conductive dust will result. Conductive dust collecting on the terminals will not prevent electricity from flowing between the terminals and the contact.

Figure 5:
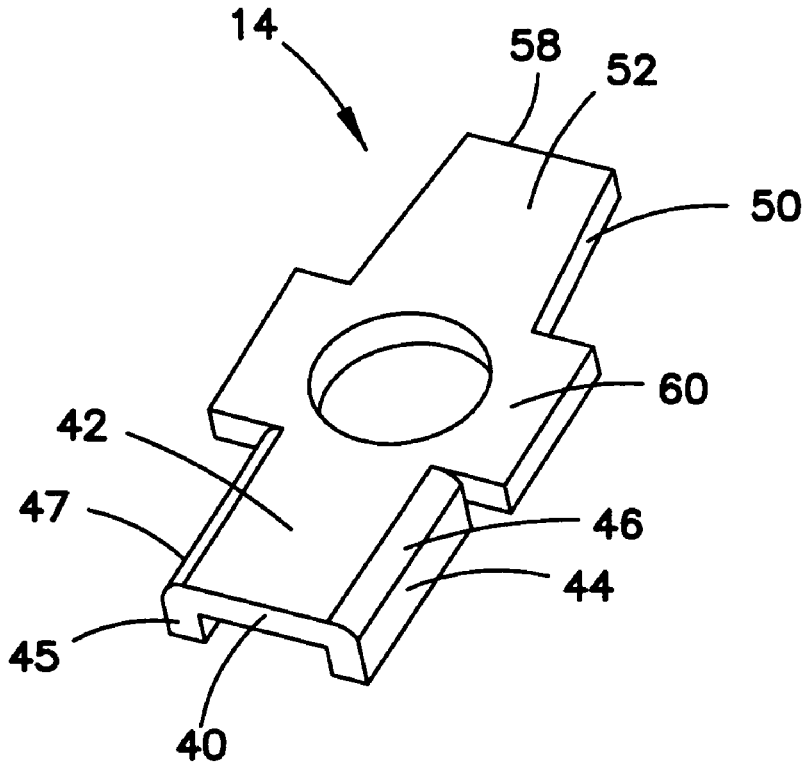
FIG. 5 shows a perspective view of the contact of the starter solenoid of FIG. 3.

FIG. 5 shows one alternative embodiment wherein the contact 14 may only include lips 44, 45 on the first side 40 of the contact. In this embodiment, the second side 50 of the contact 14 may include relatively sharp edges. The embodiment of FIG. 5 shows the second side 50 as tapered moving from the middle portion 60 of the contact 14 to the distal edge 58 of the second side. Such a tapered contact portion may further reduce the chance for wear between the contact and the channel or shield even though the contact has some sharp edges since the tapered edges are further removed from the channel sidewalls. With this arrangement, the first portion 40 of the contact 14 with rounded edges 46, 47 and lips 44, 45 may be provided in the non-shielded portion 35 of the contact channel 30 and the second portion 50 with sharp edges may be provided in the shielded portion 33 of the contact channel 30. Alternatively, depending on the desired design configuration, the contact 14 could be arranged with the rounded edges 46, 47 and lips 44, 45 of the contact 14 in the shielded portion 33 of the contact channel 30 and the second portion 50 with sharp tapered edges could be provided in the non-shielded portion 35 of the contact channel 30.

Although the present invention has been described with respect to certain preferred embodiments, it will be appreciated by those of skill in the art that other implementations and adaptations are possible. Moreover, there are advantages to individual advancements described herein that may be obtained without incorporating other aspects described above. Therefore, the spirit and scope of the appended claims should not be limited to the description of the preferred embodiments contained herein.

What is claimed is:

1. A starter solenoid comprising:

a solenoid cap defining a channel;

a first terminal and a second terminal provided on the solenoid cap;

a contact moveable within the channel between a first position where the contact touches the first and second terminals and a second position where the contact is removed from the first and second terminals, the contact comprising a first portion including a first terminal face configured to contact the first terminal when the contact is in the first position, the first portion further comprising opposing lips extending from opposite sides of the first terminal face with a curved shoulder provided between the first terminal face and each of the opposing lips; and a second portion connected to the first portion, the second portion including a second terminal face configured to contact the second terminal when the contact is in the first position; and a shield comprising an electrically conductive metal surface positioned in the channel of the solenoid cap, the shield configured to separate the contact from the solenoid cap when the contact moves between the first position and the second position, the shield including opposing walls positioned adjacent to the opposing lips, wherein the opposing lips of the contact move along the opposing walls when the contact moves between the first position and the second position.

2. The starter solenoid of claim 1 wherein the shield comprises an end wall connecting the two opposing walls, the end wall including a hole configured to receive the first terminal.

3. The starter solenoid of claim 1 wherein the second portion of the contact further comprises opposing lips extending from opposite sides of the second terminal face with a curved shoulder provided between the second terminal face and each of the opposing lips.

4. A starter solenoid comprising:

a solenoid cap defining a first terminal channel and a second terminal channel, wherein the first terminal channel and the second terminal channel include non-conductive sidewalls;

a first terminal provided on the solenoid cap in the first terminal channel;

a second terminal provided on the solenoid cap in the second terminal channel;

a contact positioned within the solenoid cap and extending between the first terminal channel and the second terminal channel, wherein the contact is moveable in the solenoid cap between a first position and a second position, the contact including a first terminal face positioned in the first terminal channel and a second terminal face positioned in the second terminal channel; and a shield including a first wall and a second opposing wall positioned in the first terminal channel, both the first wall and the second opposing wall having an electrically conductive metal surface, wherein the first terminal face is positioned between the first wall and the second opposing wall in the first terminal channel when the contact moves in the solenoid cap between the first position and the second position, the shield configured to directly engage the contact and prevent the contact from contacting the non-conductive sidewalls of the first terminal channel of the solenoid cap.

5. The starter solenoid of claim 4 wherein the contact is curved along opposing edges of the first terminal face positioned between the first wall and the second opposing wall of the shield.

6. The starter solenoid of claim 5 wherein the contact further includes two lips positioned on the opposing edges of the first terminal face and extending from the first terminal face in a perpendicular fashion.

7. The starter solenoid of claim 4 wherein the shield includes a mounting wall extending between the first wall and the second opposing wall, the mounting wall including a hole configured to receive the first terminal.

8. The starter solenoid of claim 7 wherein the first terminal includes a shaft portion and an enlarged head portion, wherein the shaft portion extends through the hole of the shield mounting wall and the enlarged head portion abuts the mounting wall.

9. The starter solenoid of claim 8 wherein the entire shield is comprised of a metallic material.

10. A method of operating a solenoid comprising:

moving a contact from an open position toward a closed position within a first terminal channel and a second terminal channel of a solenoid cap, the first terminal channel and the second terminal channel having non-conductive sidewalls;

moving the contact into direct contact with an electrically conductive metal surface of a shield positioned within the first terminal channel;

stopping movement of the contact when the contact is blocked from further movement within the first terminal channel and the second terminal channel by a first terminal and a second terminal of the solenoid; and flowing electrical current through the contact from the first terminal to the second terminal of the solenoid.

11. The method of claim 10 wherein electrically conductive dust is produced from the engagement of the contact with the electrically conductive surface of the shield, and wherein the electrically conductive dust blocks the contact from direct engagement with the first terminal or the second terminal but electrical current still flows through the contact from the first terminal to the second terminal of the solenoid.

12. The method of claim 11 wherein the electrically conductive surface of the shield includes a first wall and a second opposing wall, wherein the contact includes a first terminal face positioned between the first wall and the second opposing wall of the electrically conductive shield when the contact moves in the solenoid cap from the open position toward the closed position.

13. The method of claim 11 further comprising exciting a solenoid coil and moving a plunger rod from a first position toward a second position, wherein movement of the plunger rod from the first position toward the second position results in movement of the contact from the open position toward the closed position.

14. The method of claim 11 wherein flowing electrical current through the contact from the first terminal to the second terminal of the solenoid delivers a cranking current to a starter motor.

15. The method of claim 10 wherein the contact includes:

a first section including a first terminal face, a first lip extending from one side of the first terminal face, and a second lip extending from an opposite side of the first terminal face, wherein the surface of the contact is curved between the first terminal face and the first lip and between the second terminal face and the second lip;

a second section connected to the first section, the second section including a second terminal face; and a hole formed between the first section and the second section.

16. The method of claim 11 wherein the shield includes a first wall, an opposing second wall, and a mounting wall extending between the first wall and the opposing second wall, the mounting wall including a hole configured to receive the first terminal.

17. The starter solenoid of claim 1 wherein the channel includes electrically non-conductive sidewalls.

* * * * *